US005605256A

United States Patent [19]

Fan

[11] Patent Number: 5,605,256

[45] Date of Patent: Feb. 25, 1997

[54] FLUID DISPENSER APPARATUS

[76] Inventor: Chen-Yueh Fan, 3 Fl., No. 2, Alley 2, Lane 88, Sec. 2, Shui Yuan Rd., Hsin Chih Chen, Taipei Hsien, Taiwan

[21] Appl. No.: 360,072

[22] Filed: Dec. 20, 1994

[51] Int. Cl.[6] ..... B67D 5/06

[52] U.S. Cl. ..... 222/181.2; 222/341; 222/383.1

[58] Field of Search ..... 222/181.2, 383.1, 222/514, 518, 341

[56] References Cited

U.S. PATENT DOCUMENTS

| | | | |
|---|---|---|---|
| 2,622,539 | 12/1952 | Martin | 222/383.1 |
| 2,643,669 | 6/1953 | Logan | 222/341 |
| 3,952,918 | 4/1976 | Poitras et al. | 222/181.2 |
| 4,105,146 | 8/1978 | Broillard | 222/383.1 |
| 5,183,182 | 2/1993 | Comstock et al. | 222/514 |

FOREIGN PATENT DOCUMENTS

| | | | |
|---|---|---|---|
| 375860 | 4/1964 | Switzerland | 222/383.1 |

*Primary Examiner*—Andres Kashnikow
*Assistant Examiner*—Philippe Derakshani
*Attorney, Agent, or Firm*—Peterson, Wicks, Nemer & Kamrath, P.A.

[57] ABSTRACT

A dispenser for dispensing liquid soap including a channel, a port for coupling to a liquid soap container and a nozzle for dispensing liquid soap. A shaft with a piston is slidably mounted through the body for urging liquid soap to the nozzle and a collar received in the channel and mounted onto the shaft with a plurality of gaps. The shaft has an urging ring to permit the collar to slidably move in the body.

3 Claims, 6 Drawing Sheets

FLUID DISPENSER APPARATUS

BACKGROUND OF THE INVENTION

The present invention relates to a dispenser for dispensing a preferably viscous fluid, and particularly to a dispenser for dispensing liquid soap.

RELATED PRIOR ART

Soap dispensers have been widely used in the public lavatories and washrooms. Referring to FIGS. 6 and 7, a conventional liquid soap dispenser is shown, the dispenser is composed of a liquid soap container 60 and a dispenser assembly coupled to a threaded protrusive outlet 62 under a bottom of the container 60. A socket 63 is sized to be received within the outlet 62 with a central opening 64 for liquid soap to pass through. A bead 65 sized to block the hole 64 and a bead support 66 composed of a washer 67 with a plurality of rods 68 protruding therefrom are received in the socket 63 for controlling a liquid soap flow by an up/down action of the bead 65. A tubular body 69 has a closed end, an open end with a flange 70, a radially extending tube 71 protruding from the closed end with an inner threaded wall for engaging with the outlet 62, and a nozzle 72 radially extending from the open end for dispensing liquid soap therefrom. As shown in FIG. 7, the washer 67 of the bead support 66 is clamped by the socket 63 and the body 69 when the dispenser assembly is engaged with the liquid soap container 60.

A spring 73, a shaft 74 with a piston 75, a washer 76, a collar 77, and a seal 80 are sequentially placed within the tubular body 69 from the open end into the closed end and retained therein by means of a cap 81 to join with the flange 70 of the tubular body 69. The cap 81 has a hole 82 for the shaft 74 to pass through. A button 83 is secured onto an end of the shaft 74. The collar 77 is composed of a ring 78 and a plurality of radially inward extending blocks 79 of evenly spaced and protrudes from the ring 78 for holding the shaft 74 when the dispenser is assembled.

When the container 60 is filled with liquid soap, the soap will flow into the body 69 via the tube 71. When a user pushes the button 83, the shaft 74 will be moved toward the closed end of the body 69 and the piston 75 will generate a force to urge the soap to flow upward, then the bead 65 will block the hole 64 of the socket 63 and a flow of soap from the container 60 is then stopped.

Meanwhile, liquid soap within the body 69 will flow through the gaps between the ring 78 of the collar 77 and the shaft 74 and then flows out of the dispenser from the nozzle 72.

However, as the space between the piston 75 and an inner wall of the body 69 is narrow, it will be difficult for liquid soap to flow therethrough. Thus, the user has to apply a greater force to push the button.

Furthermore, as the bead 65 has a spherical shape, the force applied thereonto will be diverged, thus, the user has to apply a even greater force to push the button 83 as to block the hole 64.

SUMMARY OF THE INVENTION

The present invention provides a dispenser for dispensing a fluid in a container, the dispenser includes a body as mentioned in RELATED PRIOR ART, a shaft for applying a pressure to the fluid in the body, a flow control means controlling the fluid from the container in response to the pressure, a collar received within the body and slidably moved by an urging ring on the shaft.

DETAILED DESCRIPTION OF THE PREFERRED EMBODIMENTS

Figure 1:
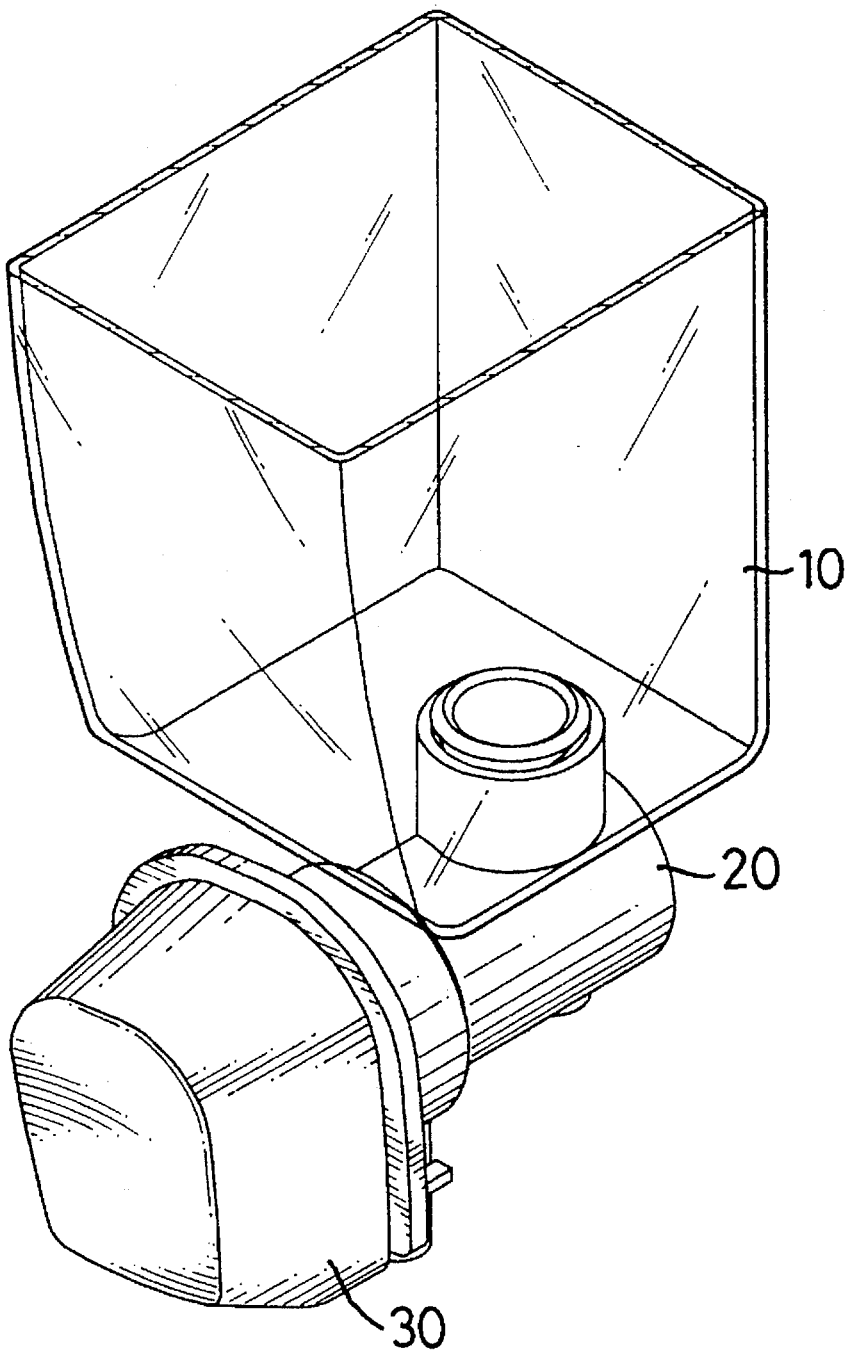
FIG. 1 is a perspective view of an embodiment of the liquid soap dispenser of the present invention.

Referring to FIG. 1, there is shown a perspective view of a liquid soap dispenser in accordance with the present invention. As shown in the drawing, a liquid soap container 10 is in combination with a dispenser assembly 20 of this invention. A button 30 is further attached to the dispenser assembly 20.

Figure 2:
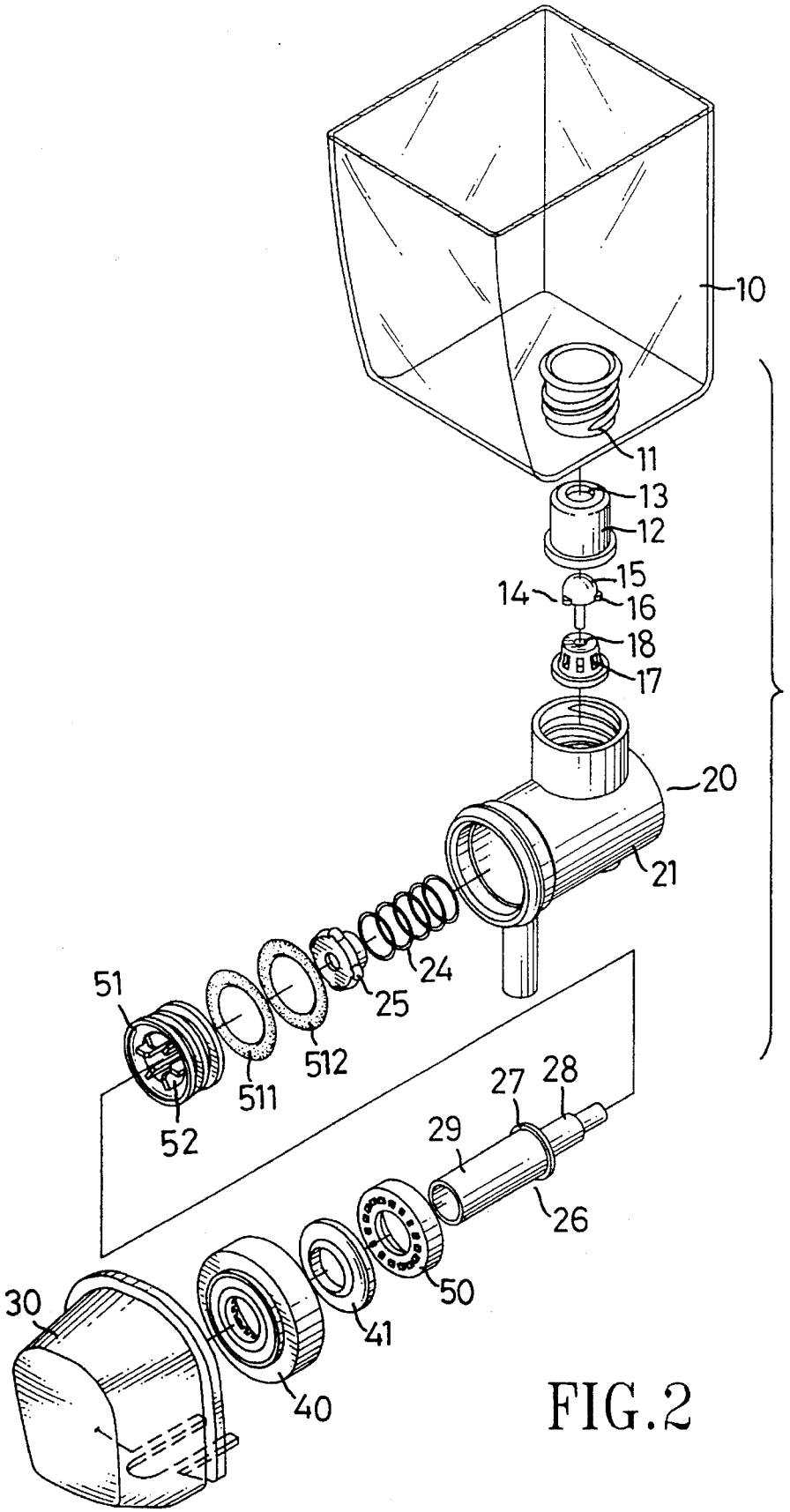
FIG. 2 is a perspective exploded view of the liquid soap dispenser of FIG. 1.
Figure 3:
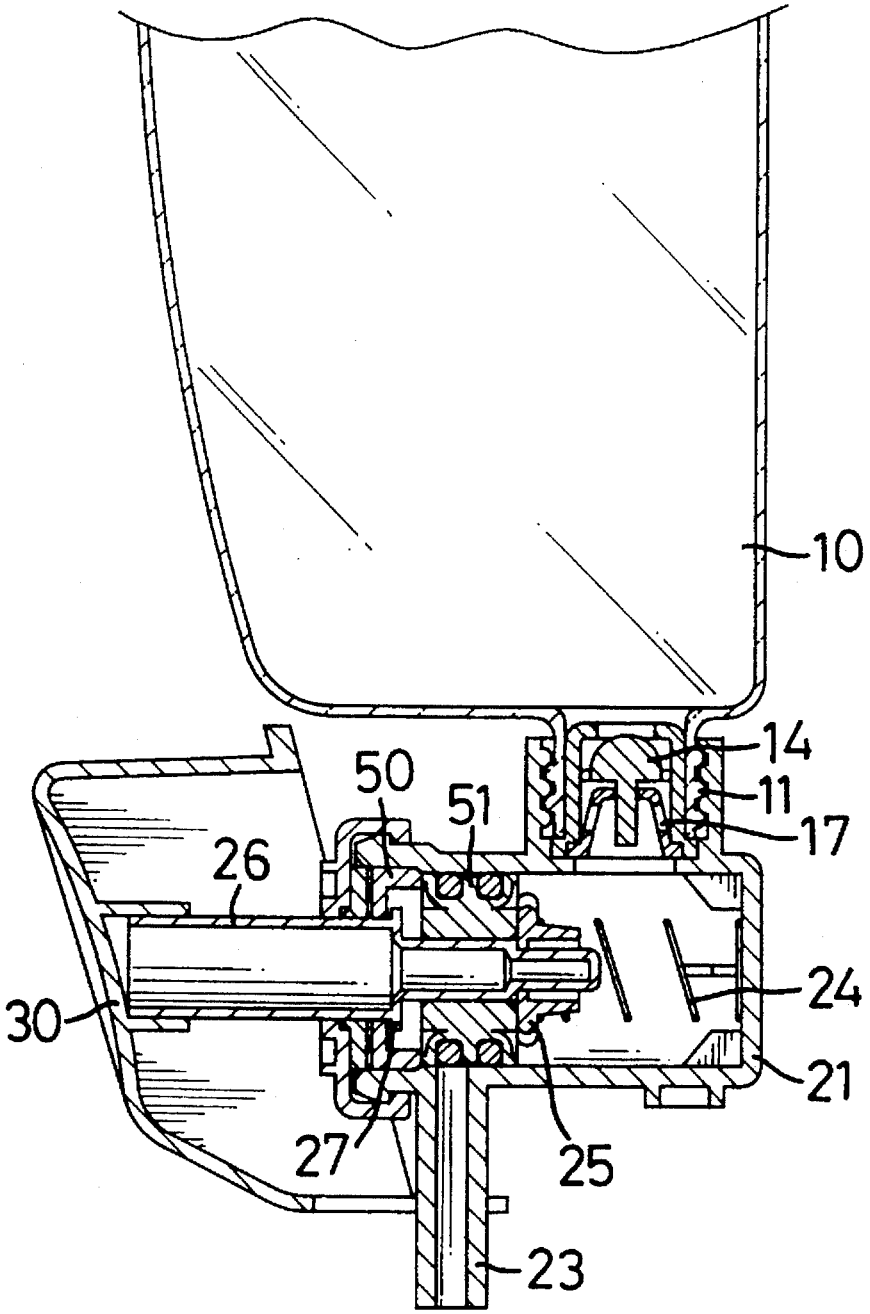
FIG. 3 is a cross-sectional view of the liquid soap dispenser of FIG. 1.

As shown in FIGS. 2 and 3, the liquid soap dispenser in accordance with this invention is shown. A liquid soap container 10 has a threaded protrusive outlet 11 under a bottom of the container 10. A socket 12 having an opening 13 for the liquid soap to pass through is received by the outlet 11. A rivet-like stopper 14 having a round head portion 15 sized to block the opening 13. A conical support 17 has an opening 18 sized to receive a shank portion of the rivet-like stopper 14 and a plurality of holes provided on a wall of the support 17 for liquid soap to pass through. The round head portion 15 can move freely between the socket 12 and the support 17. A plurality of tabs 16 are evenly disposed around a periphery of the round head portion 15 of the stopper 14 for aligning the round head portion 15 to the opening 13 of the socket 12.

A tubular body 21, identical to the tubular body 69 as described in RELATED PRIOR ART, has a closed end, an open end with a flange, a radially extending tube protruding from the closed end with an inner threaded wall for engaging with the outlet 11, and a nozzle 23 radially extending from near the open end for dispensing a fluid therefrom.

A spring 24 is secured within the body with a first end attached to an inner wall of the closed end of the body 21. A second end of the spring 24 is provided with a piston 25. A shaft 26 is further provided within the body 21 and is divided into a first portion 28 and a second portion 29 by an urging ring 27. An end of the first portion 28 is secured with the piston 25 and an end of the second portion 29 is secured with a button 30.

A collar 51, movably mounted on the first portion 28 of the shaft 26, has two elastic O-ring seals 511, 512 mounted thereon and sized to be movably received within the body 21. On the second portion 29 of the shaft 26, a bearing 50, a seal 41, and a cap 40 are sequentially mounted between the urging ring 27 and the button 30. The cap 40 is engaged with the flange of the body 21.

Figure 5:
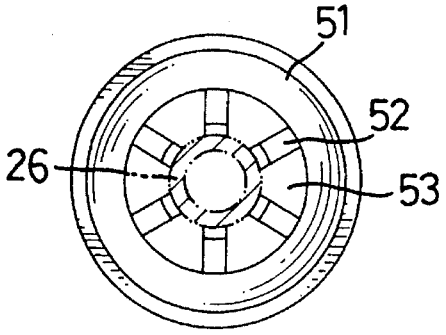
FIG. 5 is a front view showing a collar in accordance with the present invention.
Figure 6:
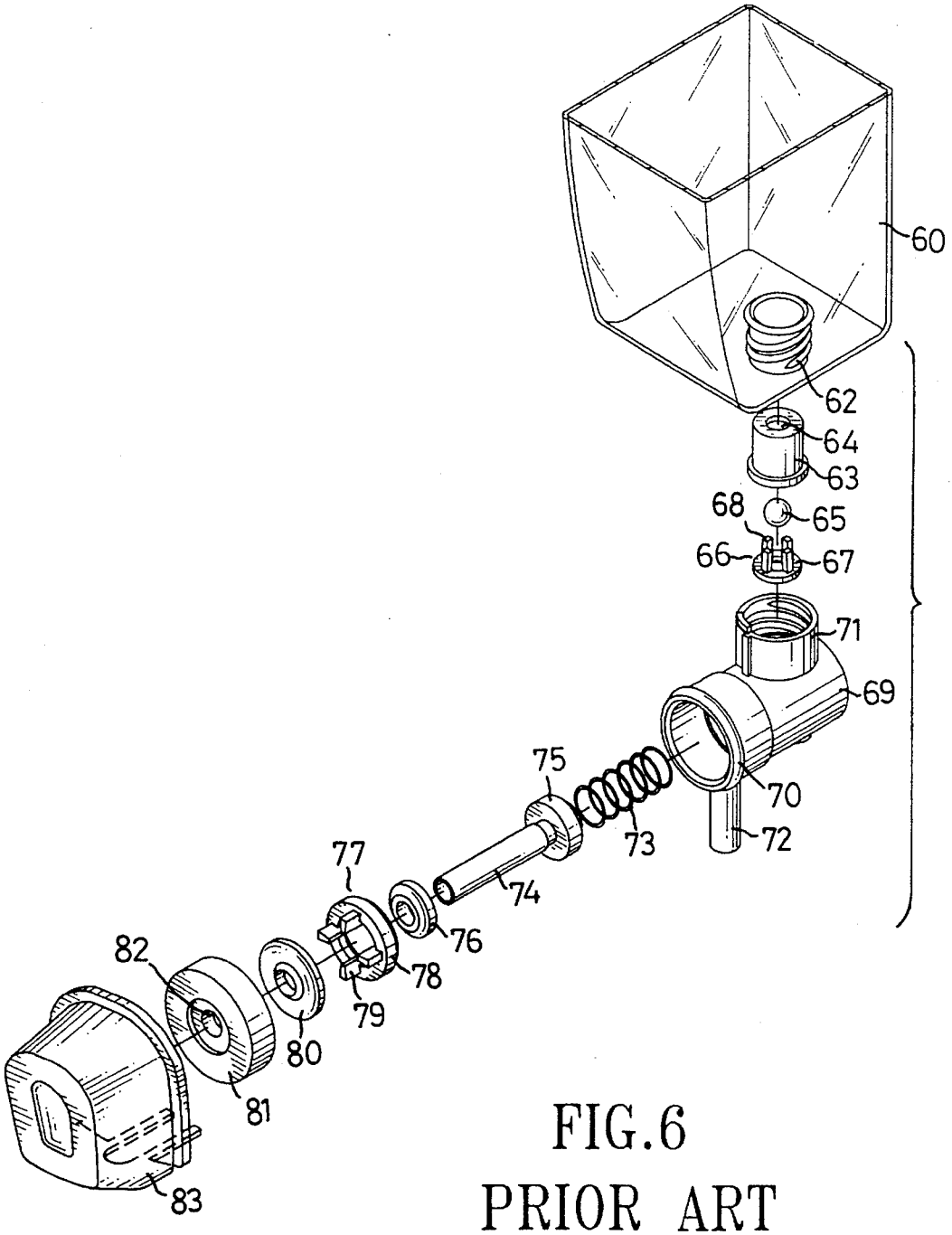
FIG.6 PRIOR ART
FIG. 6 is a perspective exploded view of a conventional liquid soap dispenser.
Figure 7:
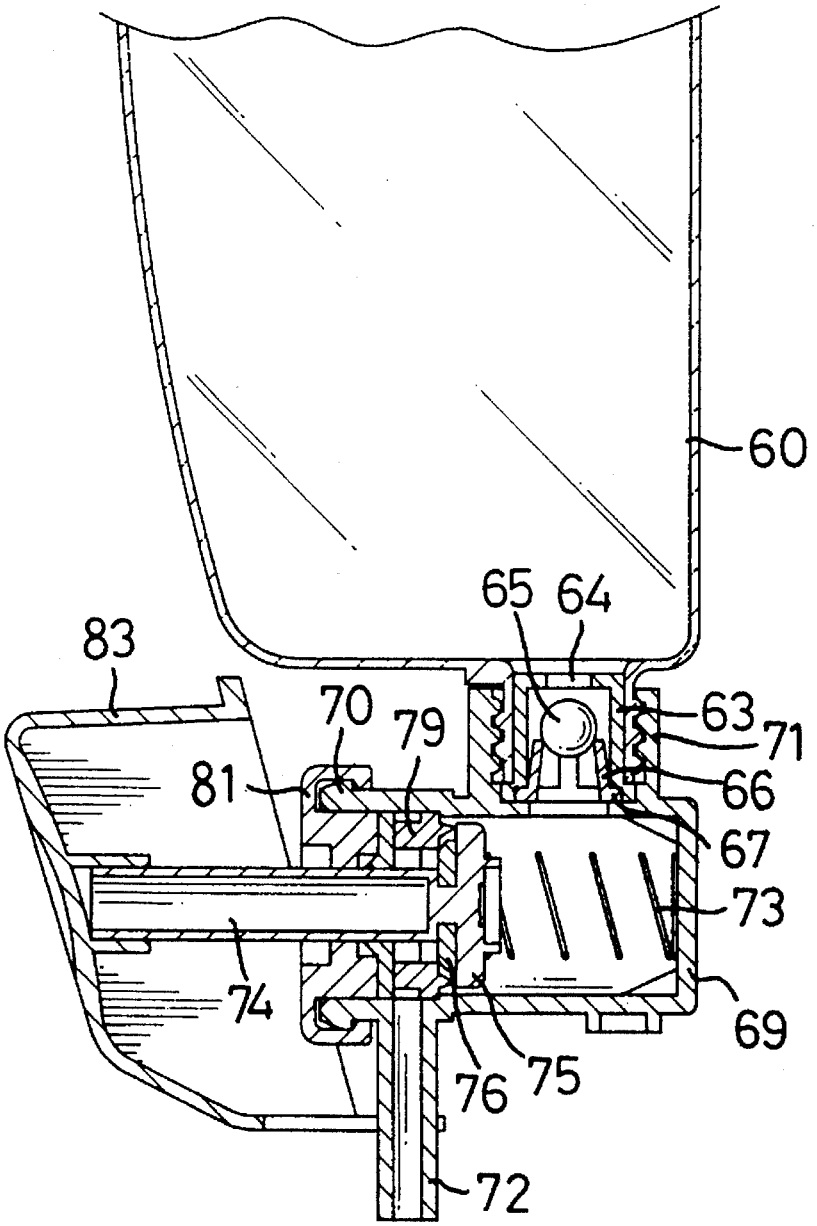
FIG.7 PRIOR ART
FIG. 7 is a cross-sectional view of the liquid soap dispenser of FIG. 6.

FIG. 5 shows the front view of the collar 51 in accordance with the present invention. Six struts 52 are equidistantly provided on an inner wall of the collar 51 and radially inward protrude to retain the shaft 26 (in phantom lines) shown in FIG. 2. The collar 51 and the shaft 26 define gaps 53 therebetween which are used as passages for liquid soap to pass through as described later.

Figure 4:
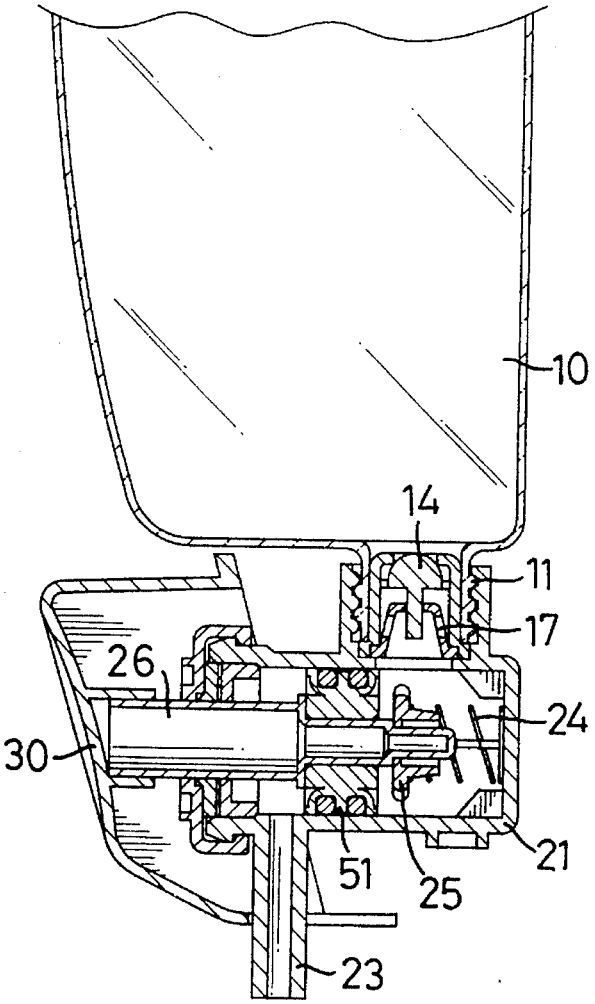
FIG. 4 is a cross-sectional view showing a button of the liquid soap dispenser is pressed.

FIGS. 3 & 4 show the detailed cross-sectional view of the liquid soap dispenser in accordance with the present invention. As the button 30 is pushed by a user, the shaft 26 and the piston 25 will be moved toward the closed end of the body 21. A fluid within the body 21 will be compressed, thus, the rivet-shaped stopper 14 will move upward to block the outlet 11 of the liquid soap container 10. Liquid soap within the body 21 will pass through the gaps 53 (shown in FIG. 5) between the collar 51 and the shaft 26. If the user continues to push the button 30, the collar 51 will be also pushed toward the closed end of the body 21 by the urging ring 27. Liquid soap will flow out of the body 21 from the nozzle 23.

When the button 30 is released by the user, the spring 24 will start to return to its extended length, and the piston 25, the shaft 26 and the collar 51 will be pushed backward to the open end of the body 21. A pressure between the closed end of the body 21 and the piston 25 will be lower than the ambient pressure. Thus, the rivet-shaped stopper 14 will drop onto the support 17. The liquid soap will flow into the body 21.

Although the invention has been explained in relation to its preferred embodiment, it is to be understood that many other possible modifications and variations can be made without departing from the spirit and scope of the invention as hereinafter claimed.

I claim:

1. A dispenser for dispensing a fluid comprising:

a body defining a channel, a port for coupling to a fluid container and a nozzle for dispensing the fluid;

a shaft slidably mounted through a wall of the body with an urging ring and a piston mounted in the body for applying a pressure to the channel from an outer wall of the body;

a flow control means having a socket secured in the port, a rivet-like stopper with a round head portion for blocking a hole of the socket, a conical support received within the socket having a opening for receiving a shank portion of the stopper thereby raising the round head portion of the rivet to block the hole of the socket in response to said pressure, and a plurality of holes on a wall of the support for the fluid to pass through for controlling the fluid from the container in response to the pressure;

a collar slidably received in the body and mounted to the shaft with a plurality of gaps between the collar and the shaft; and a spring mounted in the body for urging the piston to have the fluid to pass through the gaps.

2. A dispenser according to claim 1 wherein said shaft is stepped.

3. A dispenser according to claim 1 wherein said collar has two elastic ring seals mounted thereon.

* * * * *